US006883501B2

(12) United States Patent
Chatfield et al.

(10) Patent No.: US 6,883,501 B2
(45) Date of Patent: Apr. 26, 2005

(54) THROTTLE AND FUEL INJECTOR ASSEMBLY

(75) Inventors: Glen F. Chatfield, Bradfordwoods, PA (US); Malcolm C. Ashe, Upper St. Clair, PA (US)

(73) Assignee: Optimum Power Technology, Bridgeville, PA (US)

( * ) Notice: Subject to any disclaimer, the term of this patent is extended or adjusted under 35 U.S.C. 154(b) by 0 days.

(21) Appl. No.: 10/368,701

(22) Filed: Feb. 15, 2003

(65) Prior Publication Data

US 2003/0154962 A1 Aug. 21, 2003

Related U.S. Application Data

(60) Provisional application No. 60/357,427, filed on Feb. 15, 2002.

(51) Int. Cl.[7] ..... F02M 43/00

(52) U.S. Cl. ..... 123/527; 123/470; 123/525

(58) Field of Search ..... 123/527, 470, 123/472, 471, 525, DIG. 7

(56) References Cited

U.S. PATENT DOCUMENTS

| | | | | |
|---|---|---|---|---|
| 4,829,966 A | | 5/1989 | D'Angelo et al. | |
| 5,887,574 A | * | 3/1999 | Smith | 123/527 |
| 6,250,261 B1 | * | 6/2001 | Santarossa | 123/27 GE |
| 6,467,465 B1 | * | 10/2002 | Lorts | 123/527 |

FOREIGN PATENT DOCUMENTS

| | | |
|---|---|---|
| DE | 3200550 A1 | 7/1989 |
| EP | 0723073 A2 | 7/1996 |
| JP | 57091372 | 6/1982 |
| JP | 57153963 | 9/1982 |
| JP | 02055840 | 2/1990 |

* cited by examiner

*Primary Examiner*—Bibhu Mohanty
(74) *Attorney, Agent, or Firm*—Richard W. James

(57) ABSTRACT

A throttle and fuel injector assembly and method of controlling fuel and air supply to an engine. The assembly and method provide combustion air through a carburetor and fuel through a carburetor.

21 Claims, 11 Drawing Sheets

THROTTLE AND FUEL INJECTOR ASSEMBLY

CROSS-REFERENCE TO RELATED APPLICATIONS

This application claims benefit of U.S. Provisional No. 60/357,427 filed Feb. 15, 2002.

STATEMENT REGARDING FEDERALLY SPONSORED RESEARCH

Not Applicable.

FIELD OF THE INVENTION

The disclosed invention is related to air and fuel supply systems for internal combustion engines and, particularly, to a fuel injector combined with a carburetor that is modified such that the carburetor provides only air to the engine.

BACKGROUND OF THE INVENTION

The performance of an internal combustion engine is dependent on a number of factors including the operating cycle (e.g., two-stroke having 360 degrees of crankshaft rotation per cycle, four-stroke having 720 degrees of crankshaft rotation per cycle, or Wankel), the fuel type (e.g., gasoline or diesel) the number and design of combustion chambers, the selection and control of ignition and fuel delivery systems, and the ambient conditions in which the engine operates. Examples of design choices for a combustion chamber are believed to include choosing a compression ratio and choosing the numbers of intake and exhaust valves associated with each chamber.

With regard to fuel delivery systems, carburetors and fuel injection systems are known. Those known systems supply a quantity of fuel, (e.g., gasoline and air), in accordance with the position of the throttle as set by the operator. In the case of carburetors, fuel is often delivered by a system of orficies, known as "jets." As examples of carburetor operation, an idle jet may supply fuel downstream of a throttle valve at engine idling speeds, and that fuel delivery may be boosted by an accelerator pump to facilitate rapid increases in engine load.

Known fuel injection systems, which can be operated electronically, spray a precisely metered amount of fuel into the intake system or directly into the combustion cylinder. The fuel quantity is typically determined by a controller based on the state of the engine and a data table known as a "map" or "look-up table." The map typically includes a collection of possible values or "setpoints" for each of at least one independent variable (i.e., a characteristic of the state of the engine), which can be measured by a sensor connected to the controller, and a collection of corresponding control values, for a dependent variable control function, e.g., fuel quantity.

Further, engine performance is substantially dependent on how combustion is accomplished in the ambient conditions. The stoichiometric mass fraction ratio of air to gasoline is approximately 14.7:1. However, it is believed that ratios from about 10:1 to about 20:1 will combust, and that it is often desirable to adjust the air-fuel ratio ("AFR") to achieve specific engine performance (e.g., a certain level of power output, better fuel economy, or reduced emissions). Properly calibrating the fuel delivery system of the engine to deliver the optimum AFR under all operating conditions is important to optimum engine operation.

Vehicles are commonly manufactured having carburetors. Often, those carburetors provide high quality air flow control through, for example, a butterfly or gate type air valve. Those carburetors, however, may not provide high quality fuel delivery through a float bowl and jets. For example, an amount of fuel supplied through a fuel injector may change more rapidly in response to throttle position than the amount of fuel supplied through a float bowl and jets.

Because the quality of fuel delivery provided by a carburetor is often not as great as fuel injectors, vehicle owners desiring high quality fuel delivery often replace vehicle carburetors with throttle body fuel injectors that deliver both fuel and air to the vehicle engine. Such replacement is, however, typically expensive both in the cost of replacement parts and labor to perform the replacement. The air delivery component of the throttle body fuel injector may, furthermore, constitute a large part of the cost of replacement parts. Thus, there is a need for an apparatus and method that provides fuel injection in a carbureted engine system.

SUMMARY OF THE INVENTION

In an embodiment of the present invention, a fuel injector adapter is contemplated. The fuel injector adapter includes a coupling having a first end and a second end and forming a combustion air passageway therethrough. The first end is adapted for coupling adjacent a carburetor combustion air passage 101. The fuel injector adapter also includes a fuel injector mount formed on the coupling and forming a fuel injector passageway passing through the fuel injector mount and coupling and into which a fuel injector may be inserted.

A plate fashioned for attachment to a carburetor to prevent flow of air and fuel through a float bowl is also contemplated.

In an embodiment of the present invention, a throttle and fuel injection device is contemplated. That throttle and fuel injection device includes a carburetor and a fuel injector. The carburetor forms a combustion air passage through which combustion air is provided to the engine and through which fuel is not provided to the engine. The fuel injector is disposed in fluid communication with the combustion air passage and fuel is provided to the engine therethrough.

A method of providing combustion air and fuel to an engine is also contemplated. That method includes metering combustion air flow delivered to the engine through a carburetor and metering fuel delivered to the engine through a fuel injector in fluid communication with the carburetor.

In addition, an article of manufacture is contemplated. The article of manufacture includes a computer readable medium having instructions stored thereon. The instructions cause a processor to control combustion air flow through a carburetor and control fuel delivery through a fuel injector in fluid communication with the carburetor when executed.

BRIEF DESCRIPTION OF THE DRAWINGS

The accompanying drawings, which are incorporated herein and constitute part of this specification, include one or more embodiments of the invention and, together with the background given above and the detailed description given below, serve to disclose principles of the invention in accordance with a best mode contemplated for carrying out the invention.

DETAILED DESCRIPTION OF THE INVENTION

Reference will now be made to the preferred embodiments of the present invention, examples of which are illustrated in the accompanying drawings. It is to be understood that the figures and descriptions of the present invention included herein illustrate and describe elements that are of particular relevance to the present invention, while eliminating, for purpose of clarity, other elements found in typical engines, carburetors and fuel injectors. It is also to be understood that the preferred embodiments described herein are not exhaustive of embodiments of the invention, but are provided as examples of configurations and uses of the invention.

The throttle and fuel injection devices and techniques described herein provide solutions to the shortcomings of certain fuel delivery systems. Those of ordinary skill in engine control technology will readily appreciate that the devices and techniques, while described in connection with certain engines and fuel delivery systems, are equally applicable to other engine and fuel delivery systems, wherein air and fuel are delivered to the engine. Other details, features, and advantages of the throttle and fuel injection devices and techniques and the user interface will become further apparent in the following detailed description of the embodiments.

Any reference in the specification to "one embodiment," "a certain embodiment," or a similar reference to an embodiment is intended to indicate that a particular feature, structure, or characteristic described in connection with the embodiment is included in at least one embodiment of the invention. The appearances of such terms in various places in the specification are not necessarily all referring to the same embodiment. References to "or" are furthermore intended as inclusive so "or" may indicate one or the other ored terms or more than one ored term.

An embodiment of the present invention includes a throttle and fuel injection apparatus and method that provides combustion air for an internal combustion engine through a carburetor and for providing fuel to that internal combustion engine through a fuel injector. The method includes blocking all fuel passages leading into the carburetor and adding a fuel injector to the carburetor. Combustion air is thereby directed into the internal combustion engine through the carburetor while fuel is directed into the internal combustion engine through the fuel injector.

Figure 1:
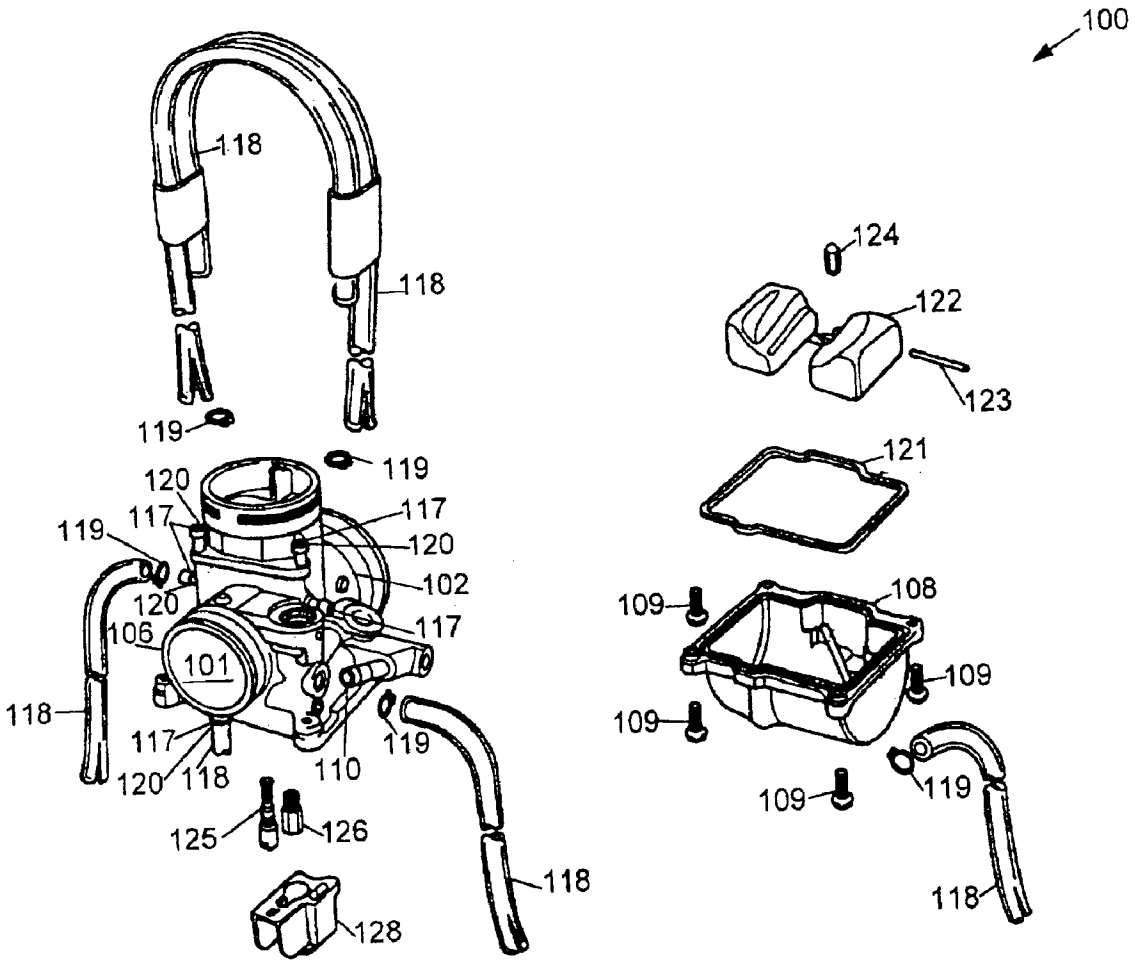
FIG. 1 is an exploded view of an unmodified carburetor that may be utilized in an embodiment of the present invention.
Figure 2:
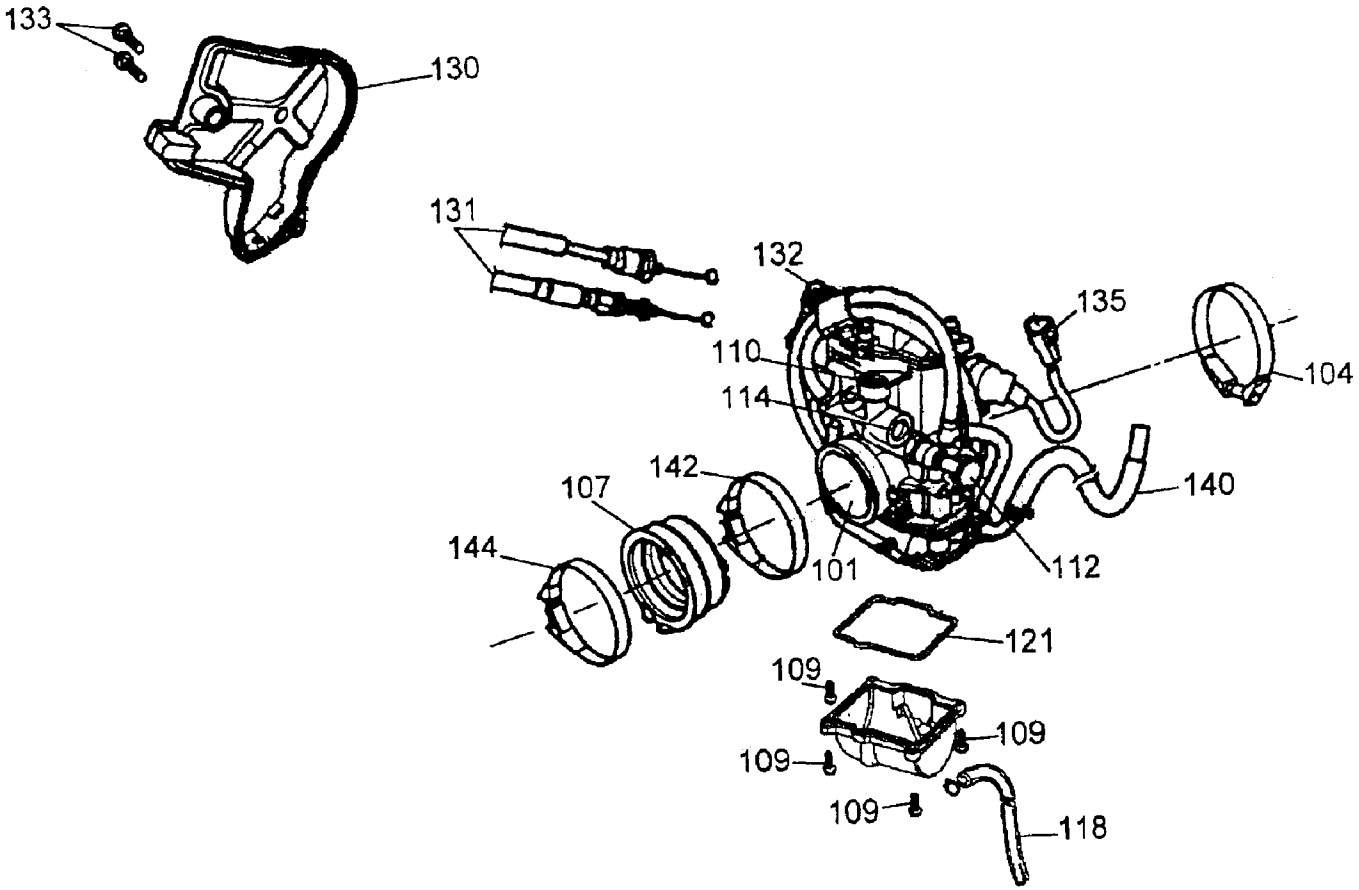
FIG. 2 is an exploded view of the unmodified carburetor of FIG. 1 that includes certain components for connecting the carburetor to an engine, a fuel source and an air source.

FIG. 1 illustrates an exploded view of an embodiment of an unmodified carburetor 100 that may be utilized in the present invention. The carburetor illustrated is appropriate for use on a motorcycle or all terrain vehicle, however, various other carburetors may alternately be used in connection with the invention. The carburetor has a carburetor inlet 102 to which, for example, an inlet connector (not shown) may be attached to attach the carburetor inlet 102 to an air cleaner and a combustion air source. A carburetor outlet 106 is shown opposite the carburetor inlet 102. An outlet connector 107 that is depicted in FIG. 2 may, for example, be used to connect the carburetor 100 to an engine intake port (not shown). The carburetor inlet 102 and carburetor outlet 106 form a combustion air passage 101 through which combustion air may pass. A throttle (not shown) is disposed in the combustion air passage 101 to control air flow therethrough.

A float bowl 108 regulates the amount of fuel flow from a fuel tank (not shown) into the carburetor 100. The float bowl in the depicted embodiment attaches to the carburetor 100 by way of bolts 109 and may be sealed to the carburetor 100 utilizing a gasket 121 compressed between the carburetor 100 and float bowl 108. Fuel flows into the float bowl 108 through a fuel inlet 110. A float 122 is attached to the float bowl 108 by way of a float pin 123, and may be raised and lowered by the level of the fuel in the float bowl 108 to permit or prevent fuel from flowing into the float bowl 108 as desired. From the float bowl 108, a needle valve 124 operates in conjunction with one or more jets, such as an idle jet 125 and a main jet 126 to regulate the flow of fuel into the combustion air stream that flows through the carburetor 100. A spacer 128 may also be utilized. A throttle position sensor (not shown) may be attached to the depicted carburetor 100 and may be used to communicate the desired load that the operator wishes to impose upon the engine to the carburetor 100 such that appropriate fuel and air will be permitted to flow through the carburetor 100 and into the engine. The throttle position sensor may also communicate the desired load to the engine control unit 460 illustrated in FIG. 11.

The carburetor 100 is an analog device used to regulate air and fuel flow into an engine. To regulate the fuel flow accurately, the carburetor 100 may require atmospheric pressure to be present at various locations 117. Tubes 118 may be attached to the carburetor 100 at a throttle connection 132 to assure that atmospheric pressure is present at each of those locations 117. Those tubes 118 may be attached to ports 120 at the desired locations 117 by way of clamps 119.

Figure 11:
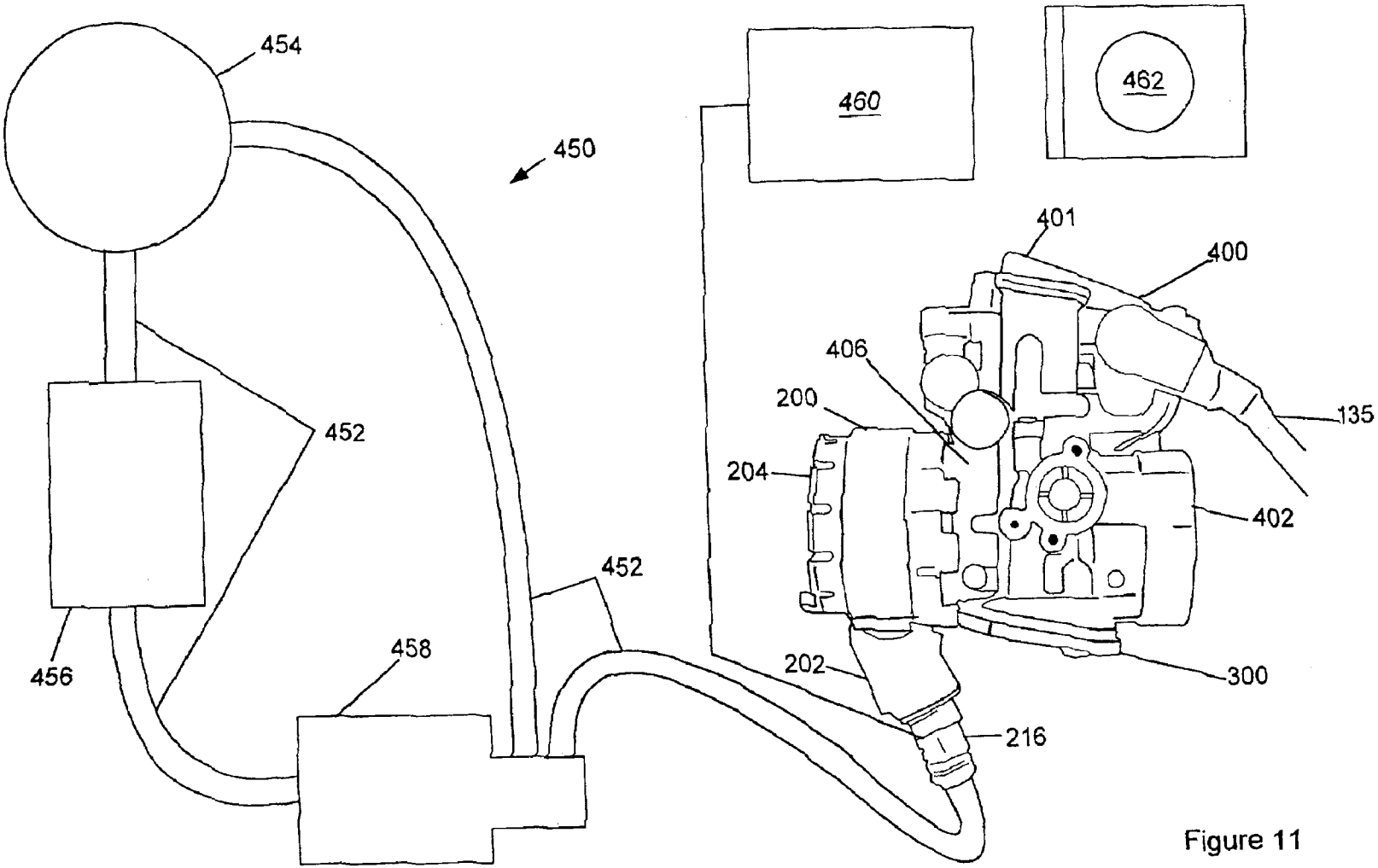
FIG. 11 is an embodiment of a fuel supply and control system for the throttle and fuel injector assembly of the present invention.

FIG. 2 illustrates the carburetor 100 of FIG. 1 with additional components that may be attached to the carburetor 100. One or more throttle cables 131 may attach to the carburetor 100 and be actuated by an operator by actuating the throttle control (not shown). A throttle cable cover 130 may be attached to the carburetor 100 by bolts 133 to cover the throttle cables 131. The throttle cables 131 control the opened to closed position of a throttle (not shown) inside the carburetor 100. The throttle may, for example, be a butterfly type or a slide type throttle. The closed throttle position would be appropriate for an engine at a no load condition, such as when idling. As the operator adjusts the throttle control to increase the engine load, the throttle moves gradually from its closed position to a wide open position. A throttle position wire 135 that provides an electronic throttle position signal to, for example, an engine control unit 460 as shown in FIG. 11 may also be provided to the carburetor 100.

FIG. 2 also illustrates attachment of a fuel line 140 to the carburetor 100 at 110 and other components for attaching the carburetor to a combustion air intake and an engine. An inlet clamp 104 is disposed at the carburetor inlet 102 to attach the carburetor inlet 102 to, for example, an air cleaner or an inlet connector (not shown). An outlet clamp 142 is depicted at the carburetor outlet 106 to attach the carburetor outlet 106 to the outlet connector 107. An engine clamp 144 is disposed to attach the outlet connector 107 to a combustion air and fuel inlet of the engine.

A choke 112 is also depicted on the carburetor 100. The choke 112 may be manipulated to enrich the fuel to facilitate, for example, cold engine starts. A hot start may also be provided at 114 to regulate fuel or air flow to facilitate engine starts when the engine is hot.

Figure 3:
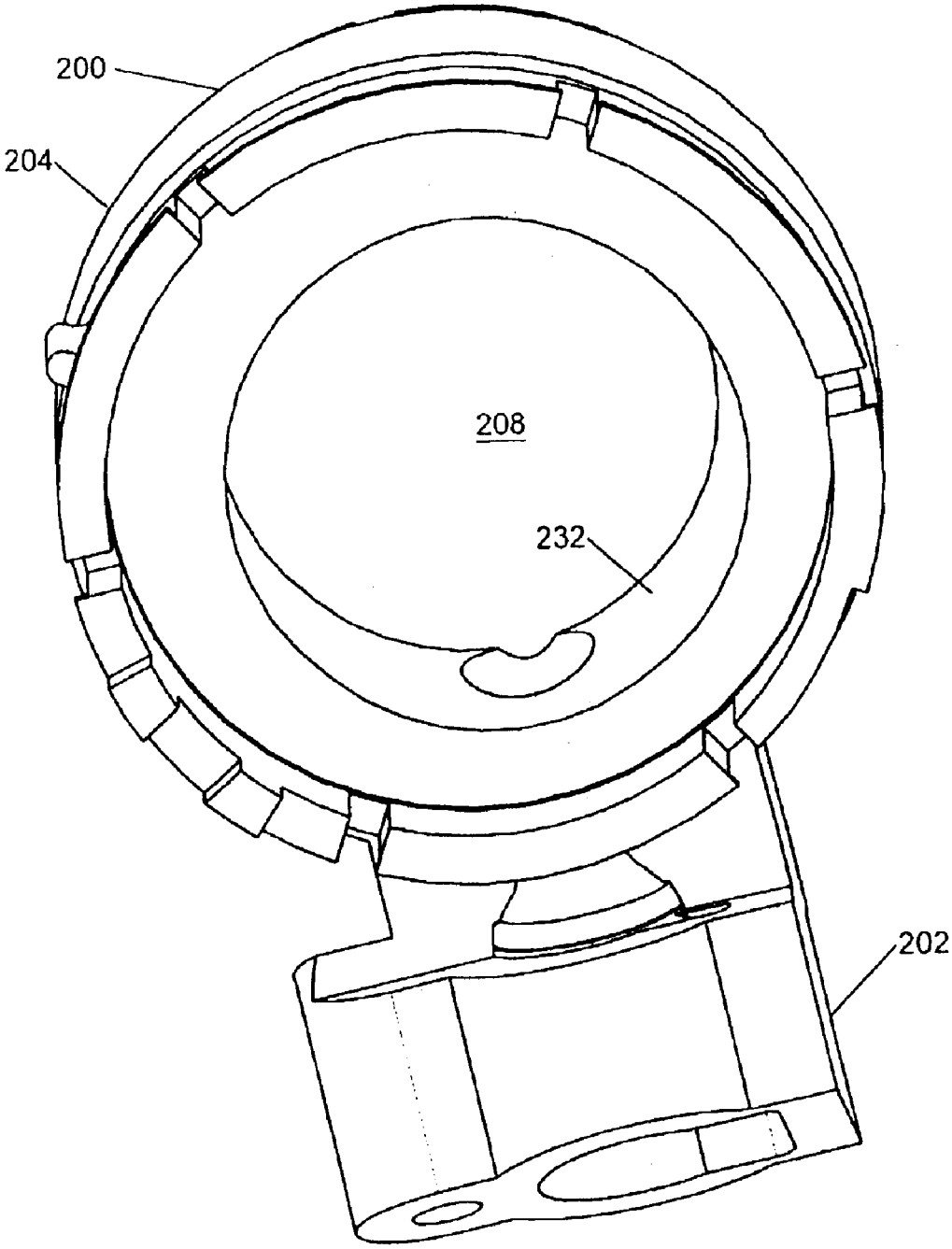
FIG. 3 is an end view of a fuel injector adapter in an embodiment of the present invention.

FIG. 3 illustrates an embodiment of a fuel injector adapter 200 of the present invention. The fuel injector adapter 200 may permit disposition of a fuel injector 216 in a desired position in an engine fuel and air supply system where that fuel injector 216 was not previously disposed. The fuel injector adapter 200 includes a fuel injector mount 202 and a fuel injector coupling 204. A clamp such as the inlet clamp 104 or the outlet clamp 142 may be used to connect the fuel injector coupling 204 to the carburetor outlet 106 or the carburetor inlet 102 and another clamp such as the engine clamp 144 may be utilized to attach the fuel injector coupling 204 to the engine intake.

The fuel injector coupling 204 forms an inlet passageway 208. The inlet passageway 208 may be a smooth unobstructed airtight passageway through which air or fuel and air may pass. The inlet passageway 208 may also be of approximately the same cross-sectional area as the combustion air passage 101 to minimize the restriction of airflow through the fuel injector coupling 204. The fuel injector coupling 204 and fuel injector mount 202 may be fabricated from nylon such that they form a rigid airtight connection to the carburetor 100 when coupled to the carburetor 100. Alternately, the fuel injector coupling 204 and fuel injector mount 202 may be fabricated from a metal, plastic, rubber or another rigid or semi-rigid material. Where one end of the fuel injector coupling 204 is attached to the carburetor outlet 106, the opposite end of the fuel injector coupling 204 may be attached to the intake port of the engine. Where one end of the fuel injector coupling 204 is attached to the carburetor inlet 102, the other end of the fuel injector coupling 204 may be attached to an air cleaner or may be exposed directly to the atmosphere. Other configurations including, for example, connection of the inlet connector to tubes leading to an engine inlet or combustion air source are also contemplated.

Figure 4:
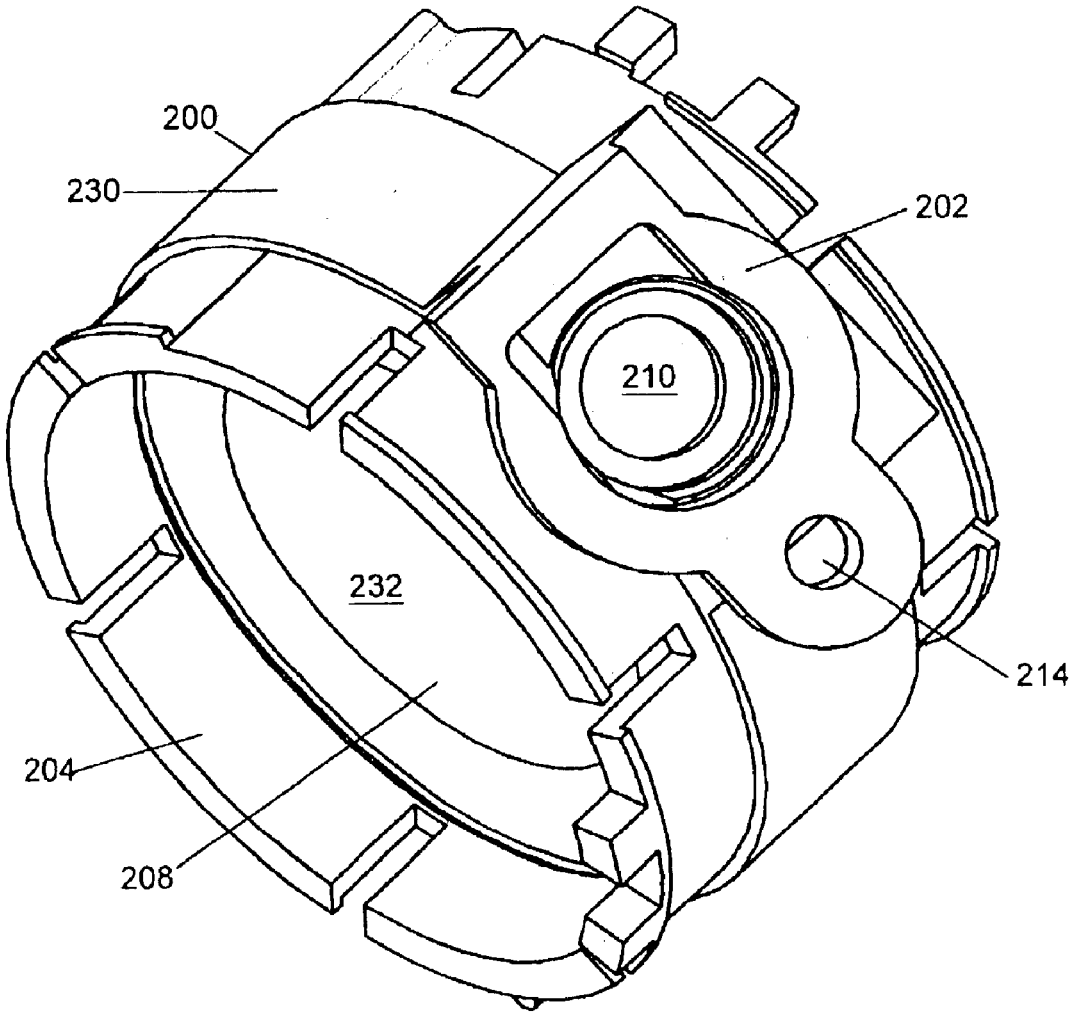
FIG. 4 is a side view of the fuel injector adapter of FIG. 3, looking into an external side of a fuel injector housing.
Figure 6:
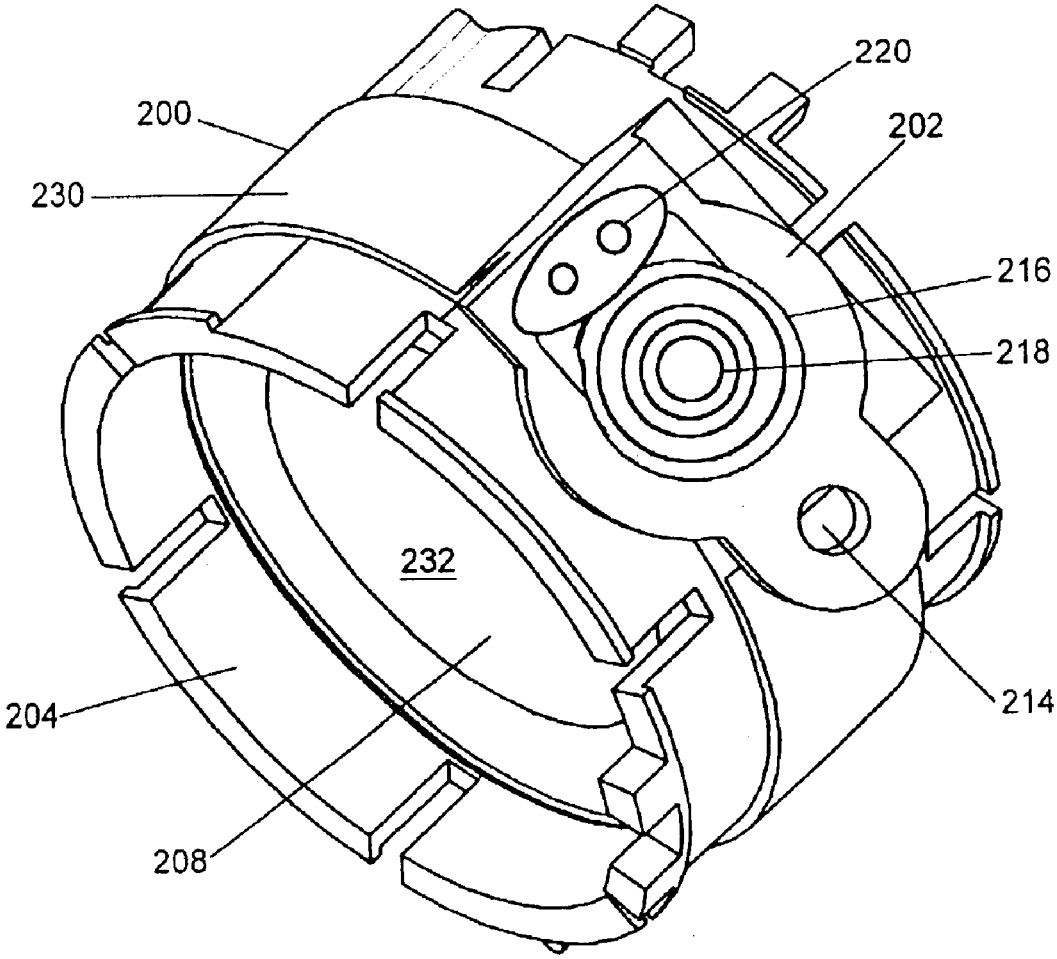
FIG. 6 is a side view of the fuel injector adapter of FIGS. 3–5, looking into an external side of a fuel injector mount and having a fuel injector disposed in the fuel injector mount.

FIG. 4 depicts the fuel injector adapter 200 with a view into the fuel injector mount 202 from an exterior surface 230 of the fuel injector adapter 200. A fuel injector passageway 210 passes through the fuel injector mount 202 and the fuel injector coupling 204 to permit a fuel injector 216 to be inserted therethrough, as illustrated in FIG. 6. The fuel injector 216 may, thus, spray fuel into the inlet passageway 208 to be delivered to the engine intake. The fuel injector mount 202 may have an irregular shape to orient the fuel injector 216 that is inserted into the fuel injector mount 202 in a desired position. The fuel injector mount 202 may also include a hole 214 that allows a clamp (not shown) to secure the injector 216 in the fuel injector mount 202.

Figure 5:
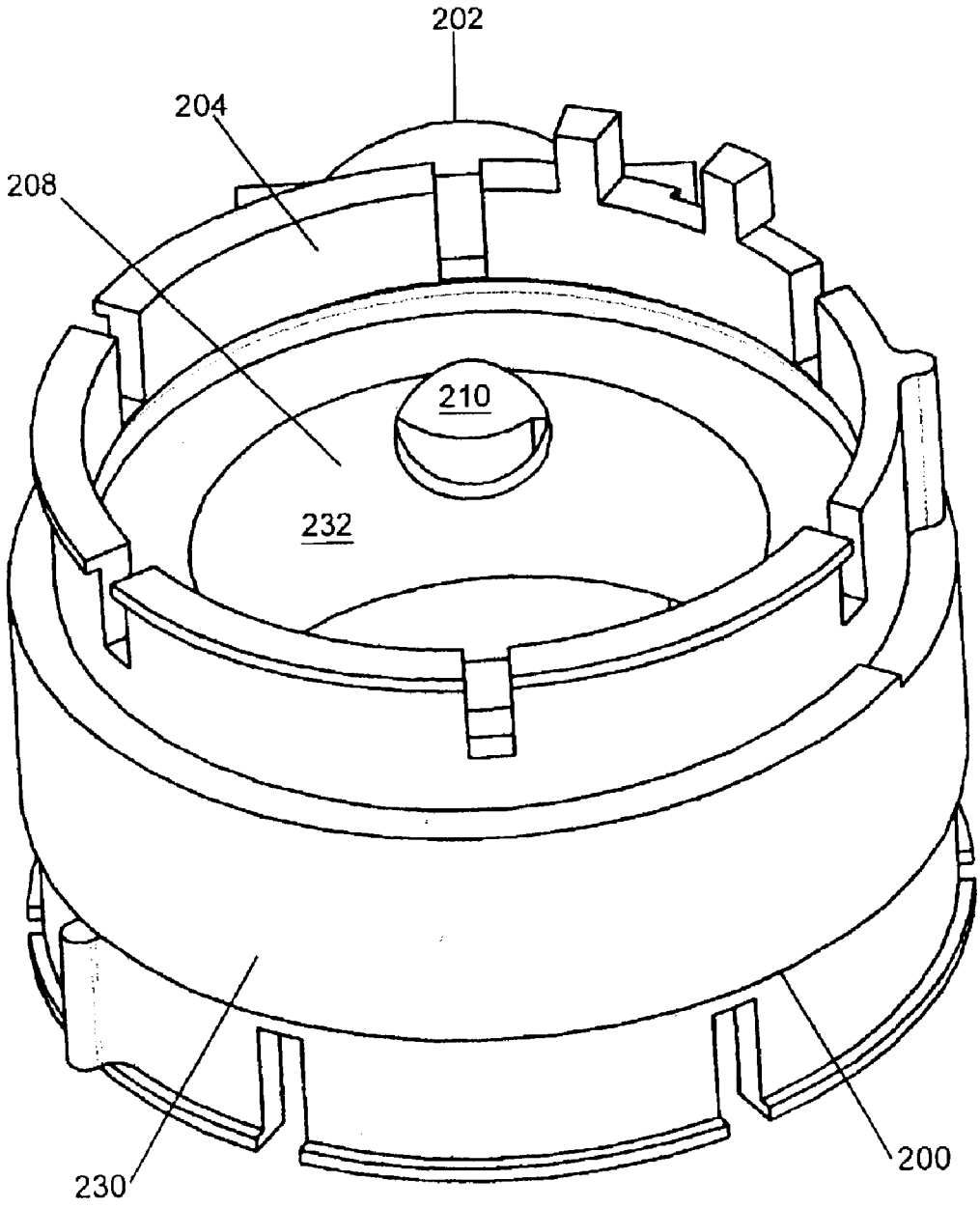
FIG. 5 is a side view of the fuel injector adapter depicted in FIGS. 3 and 4, looking into an internal side of the fuel injector housing.

FIG. 5 illustrates the fuel injector adapter 200 with a view into the fuel injector mount 202 from the interior surface 232 of the fuel injector mount 202. As may be seen, the fuel injector passageway 210 is open to permit fuel from the fuel injector to be injected into the inlet passageway 208.

FIG. 6 illustrates the fuel injector adapter 200 as viewed from the exterior surface 230 of the fuel injector mount 202, with a fuel injector 216 inserted into the fuel injector mount 202. The fuel injector 216 may be a commercially available fuel injector and may include a pressurized fuel inlet port 218 and an electronic solenoid connector terminal 220. The solenoid connector terminals 220 may be attached to an output of an engine control unit such as the engine control unit 460 depicted in FIG. 11. That engine control unit 460 may control fuel flow to the engine through the fuel injector 216 when the high pressure fuel inlet port 218 is attached to a regulated fuel supply, such as the fuel supply 450 illustrated in FIG. 11.

Figure 7:
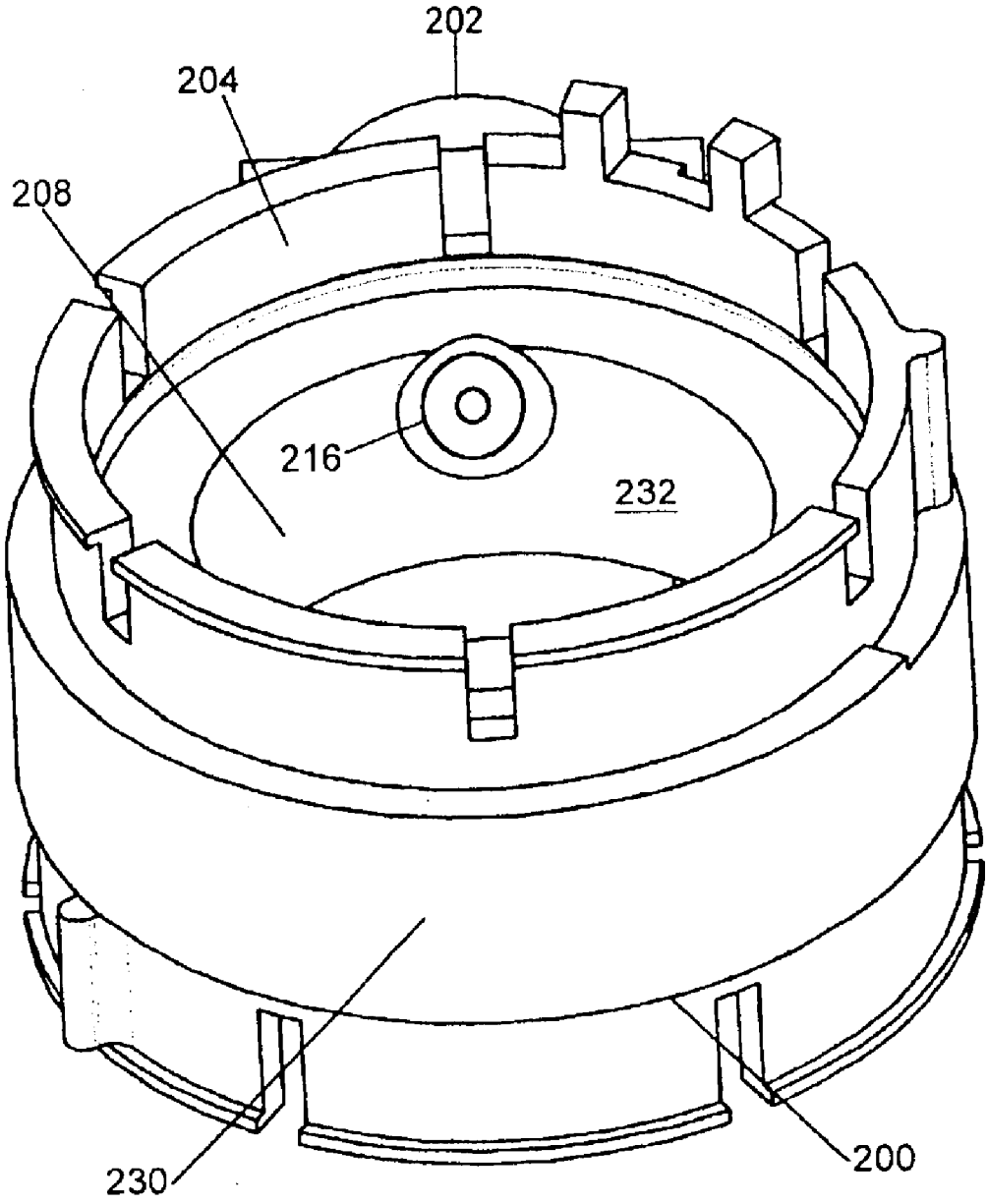
FIG. 7 is a side view of the fuel injector adapter of FIGS. 3–6, looking into an internal side of a fuel injector mount and having a fuel injector disposed in the fuel injector mount.

FIG. 7 illustrates the fuel injector adapter 200 as viewed from the interior surface 232 of the fuel injector mount 202, with a fuel injector 216 inserted into the fuel injector mount 202. As may be seen in FIG. 7, the fuel injector mount 202 may be angled into the fuel injector adapter 200 to direct fuel provided from the fuel injector 216 to be targeted to the engine intake port.

Figure 8:
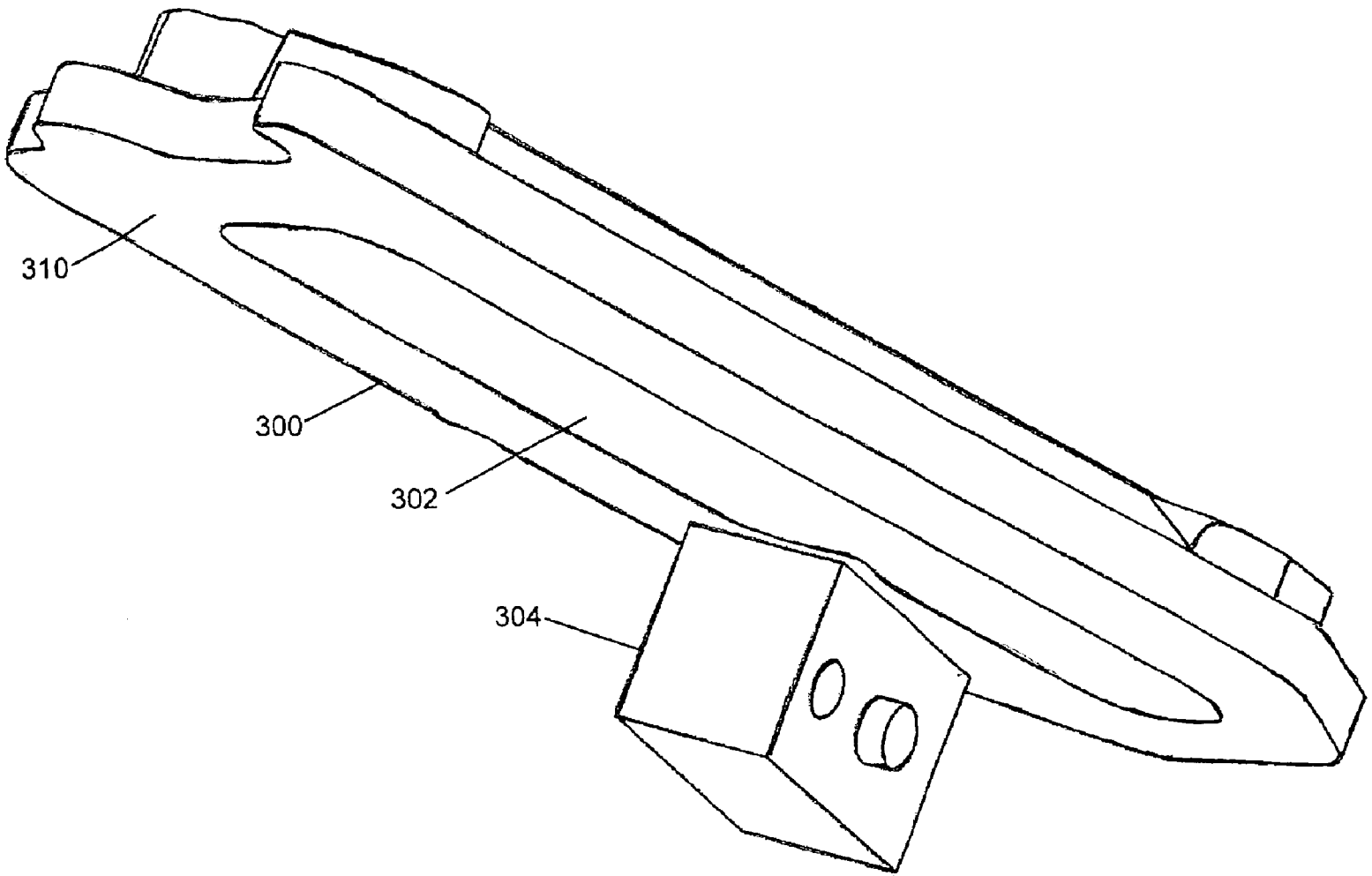
FIG. 8 is an outside and side view of an embodiment of a float bowl eliminator of the present invention.

FIG. 8 illustrates an outside and side view of a float bowl eliminator 300. Because the present invention does not necessitate use of the float bowl 108 in the carburetor 100, the float bowl 108 may be removed and an airtight plate such as the float bowl eliminator 300 or other apparatus may be connected to the carburetor 100 in place of the float bowl 108. Replacing the float bowl 108 with the float bowl eliminator 300 beneficially prevents air or fuel from flowing through the float bowl 108. Replacement of the float bowl 108 with the float bowl eliminator 300 also opens space previously occupied by the float bowl 108 in which other components may be fitted. For example the fuel injector 216 may be angled into the area previously occupied by the float bowl 108 for proper targeting of fuel. Moreover, other fuel supply components, such as a fuel pump 458, pressure regulator 454, or fuel filter 456, illustrated in FIG. 11, may be located in the space freed by removal of the float bowl 108. The present invention may, however, operate with the float bowl 108 remaining intact, and thus does not require replacing the float bowl 108 with the float bowl eliminator 300.

Figure 9:
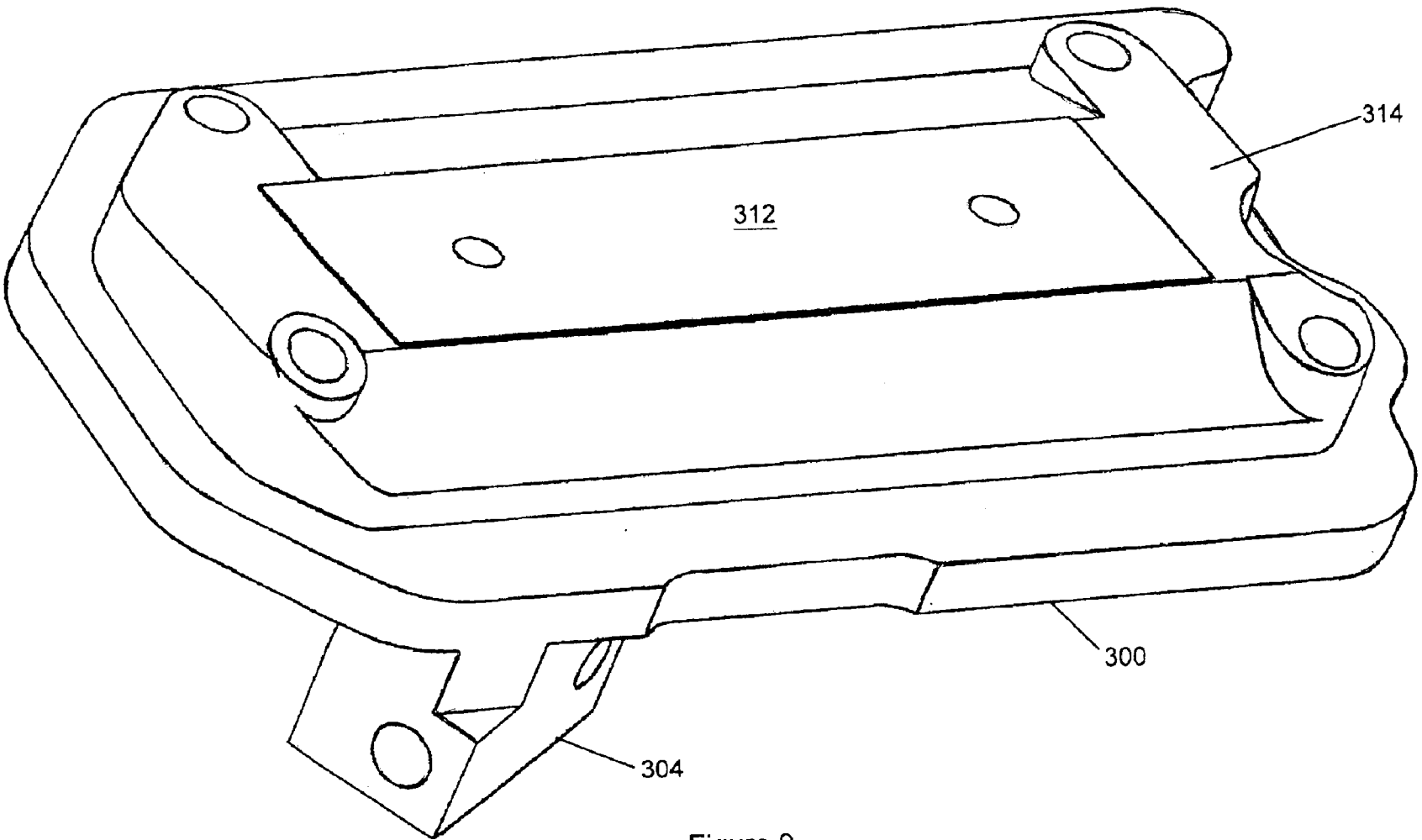
FIG. 9 is an inside and side view of the float bowl eliminator of FIG. 8.

FIG. 9 depicts an inside and side view of the float bowl eliminator 300 of FIG. 8, having an inner surface 314. The float bowl eliminator 300 may be formed in any configuration suitable for the carburetor 100 to be modified. In the example illustrated in FIGS. 9 and 10, the float bowl eliminator 300 is a plate having a depression 302 in the outside surface 310 and an idle adjustment device bracket 304 formed on the outside surface 310 of the float bowl eliminator 300. An idle adjustment device (not shown) may thus be conveniently attached to the idle adjustment bracket 304 if desired. A carburetor ring bracket 312 may be formed on the inside surface 314 to accept a ring (not shown) that is the same diameter as the carburetor intake 104 and carburetor outlet 106. Such a ring is commonly used with split-style throttles as a guide in which the throttle may slide.

Figure 10:
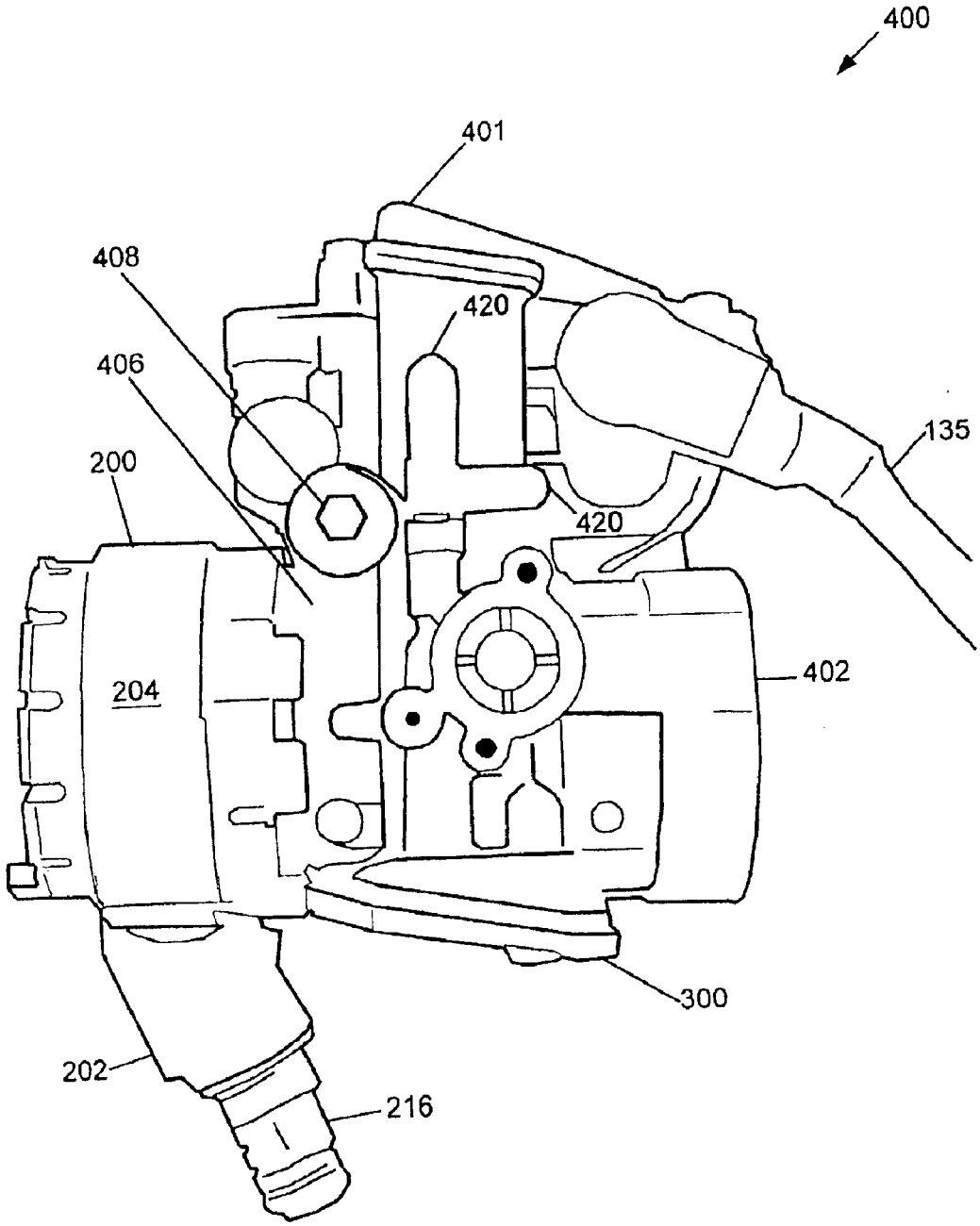
FIG. 10 is a side view of an embodiment of a throttle and fuel injector assembly of the present invention.

FIG. 10 illustrates an embodiment of a throttle and fuel injector assembly 400 of the present invention. The throttle and fuel injector assembly 400 includes a modified carburetor 401, a fuel injector adapter 200 having a fuel injector 216 disposed therein, and a float bowl eliminator 300. The modified carburetor 401 depicted in that embodiment is a modified version of the carburetor 100 depicted in FIGS. 1 and 2. The modified carburetor 401 retains airflow control components of the carburetor 100 while eliminating fuel delivery components of the carburetor 100.

As may be seen in FIG. 10, the float bowl 108 has been removed in the modified carburetor 401 and the float bowl eliminator 300 has been attached to modified carburetor 401 in place of the float bowl 108. Tubes 118 have been removed from the modified carburetor 401 and the ports 420 have been sealed by, for example, capping or plugging them to prevent air leakage therethrough. Moreover, the choke 112 has been removed and a plug 408 has been installed in its place. The throttle position wire 135 has been retained and the throttle position cables 131 may also or alternately be retained to control the positioning of the throttle. Moreover the throttle has been retained in the modified carburetor 401 and the carburetor inlet 402, as well as the carburetor outlet 406 have all been retained. The purpose of the modifications made, including attachment of the float bowl eliminator 300 and inclusion of the of the sealing plug 408 and the sealing of the ports 420, is to minimize air leakage into and out of the modified carburetor 401, thereby making the modified carburetor 401 a more accurate airflow control device.

The present invention may be utilized with any known carburetor. Where a slide-type carburetor is utilized, the invention retains the beneficial opening characteristics of the slide throttle and the superior wide open flow characteristics of the slide throttle. It has also been found that positioning the fuel injector 216 at the bottom of the fuel injector adapter 200 and thus targeting injected fuel into the bottom of the airstream is beneficial when utilizing the present invention with a slide throttle. That bottom positioning has been found to create less stratification of fuel in the combustion airstream and better distribution of fuel in the airstream. That may be due to the normal operation of a slide throttle, which permits combustion air to flow through the bottom of the combustion air passage 101 as it opens from a closed position, thus creating better mixture of fuel injected at the bottom of the fuel injector adapter 200 with the combustion air entering at the bottom of the combustion air passage 101. Fuel injection timing, which may be controlled by an engine control unit 460 as illustrated in FIG. 11 may also be important to optimize combustion of the air and fuel mixture in the engine.

In FIG. 10, the fuel injector adapter 200 has been attached to the modified carburetor outlet 406. As was previously noted, the fuel injector adapter 200 may alternately be attached to the modified carburetor inlet 402. It has been found that the fuel spray can be well targeted toward the engine intake when the fuel injector is located downstream of the modified carburetor 401, (i.e., at the outlet 406 of the modified carburetor 401). The fuel injector 216 depicted may in turn be connected to a regulated fuel supply such as the regulated fuel supply 450 shown in FIG. 11.

The modified carburetor 401 may include an inlet connector (not shown), that differs in length from a stock inlet connector that may have attached the carburetor 100 in stock form to a combustion air source such as an air cleaner. The fuel injector adapter 200 in the illustrated embodiment has been lengthened from the length of the original outlet connector (not shown) that attached the carburetor 100 to the engine intake port (not shown). Accordingly, the length of the inlet connector may be reduced by an amount equal to the amount by which the fuel injector adapter 200 has been lengthened over the stock outlet connector so that the throttle and fuel injector assembly 400 will fit in the same space that the carburetor 100 and its connectors originally occupied.

The throttle of the modified carburetor 401 may be operated to open and close in the same manner as the throttle of the unmodified carburetor 100. Thus, airflow in the throttle and fuel injector assembly 400 is controlled in a manner like air flow is controlled in the carburetor 100, while fuel in the throttle and fuel injector assembly 400 is provided by the fuel injector 116.

FIG. 11 depicts a fuel supply system 450 that may be utilized in connection with the throttle and fuel injector assembly 400. Fuel is provided to the fuel injector 216 from a fuel tank (not shown) through a fuel supply line 452. In the embodiment illustrated, that fuel flowing from the fuel tank to the fuel injector 216 flows through a pressure regulator 454, a fuel filter 456, and a fuel pump 458. Various standard commercially available pressure regulators 454, fuel filters 456, and fuel pumps 458 may be selected as desired for the engine application used in connection with the present invention.

FIG. 11 also illustrates an engine control unit 460. Such an engine control unit 460 may be utilized to control operation of the fuel injector 216 and, if desired, the throttle. An unmodified carburetor 100 may include electronic control or may be a purely mechanically controlled device. In a purely mechanically controlled carburetor control, particularly during a transition from one throttle position to another throttle position, can be difficult and add complexity to the throttle control system. Fuel injected systems typically are controlled by an engine control unit 460 and may take into consideration various sensed data to provide excellent fuel control even during throttle transitions. For example, in addition to throttle position, engine speed may be sensed by an engine control unit 460. Utilization of those signals and possibly even historic values of those signals can provide excellent fuel control even during transitions in throttle position. The engine control unit may alternately or in addition sense combustion air flow by, for example, a mass air flow sensor located in the combustion air intake to control or improve control of the quantity of fuel injected. Again alternately or in addition, a sensor disposed in the exhaust gas ejected from the engine, such as a lambda sensor or oxygen sensor, may provide may be used to control or improve control of the quantity of fuel injected by providing information regarding the efficiency of previous combustion cycles.

In one embodiment, the engine control unit 460 receives inputs from sensors that indicate engine desired load and engine speed. In the embodiment illustrated in FIG. 11, engine desired load is sensed by way of the throttle position sensor and is communicated by way of a throttle position wire 135. Engine load could be sensed in various ways including, for example, by sensing pressure or vacuum in the inlet passageway 208. Engine speed may be sensed in various ways including use of a toothed wheel (not shown) or an engine encoder (not shown).

The engine control unit 460 includes a processor and memory. Program instructions and maps may be stored in the memory. The program instructions may be in the form of software loaded into the engine control unit 460 from, for example, a disk 462. Those instructions may furthermore determine from the sensed desired load and engine speed the amount of fuel and combustion air to be provided to the engine through the throttle and, if desired, the fuel injector assembly 400. The engine control unit 460 may then operate the fuel injector 216 and the modified carburetor 401 to provide the desired quantities of fuel and combustion air.

While the present invention has been disclosed with reference to certain embodiments, numerous modifications, alterations, and changes to the described embodiments are possible without departing from the scope of the present invention, as defined in the appended claims. Accordingly, it is intended that the present invention not be limited to the described embodiments, but that it have the full scope defined by the language of the following claims, and equivalents thereof.

What is claimed is:

1. An engine fuel and air delivery apparatus, comprising:

a carburetor forming a combustion air passage through which combustion air is provided to the engine and through which fuel is not provided to the engine; and a fuel injector in fluid communication with the combustion air passage and through which fuel is provided to the engine.

2. The engine fuel and air delivery apparatus of claim 1, wherein the fuel injector is disposed through a fuel injector adapter adjacent to the combustion air passage.

3. The engine fuel and air delivery apparatus of claim 2, wherein the fuel injector adapter is connected adjacent to an outlet of the combustion air passage.

4. The engine fuel and air delivery apparatus of claim 2, wherein the fuel injector adapter includes a coupling that forms a passageway and wherein the passageway has approximately the same cross-sectional area as the combustion air passage.

5. The engine fuel and air delivery apparatus of claim 1, further comprising one or more plugs preventing airflow into and out of the carburetor other than through the combustion air passage.

6. The engine fuel and air delivery apparatus of claim 1, further comprising an airtight plate attached to the carburetor in place of a float bowl.

7. The engine fuel and air delivery apparatus of claim 1, further comprising:

an engine control unit having an output coupled to the fuel injector and controlling operation of the fuel injector and an input; and an engine load sensor coupled to the engine control unit input and on which fuel injection control is based.

8. The engine fuel and air delivery apparatus of claim 7, wherein the engine load sensor includes a throttle position sensor and an engine speed sensor.

9. The engine fuel and air delivery apparatus of claim 7, wherein the engine load sensor includes a combustion air flow sensor.

10. The engine fuel and air delivery apparatus of claim 7, wherein the engine load sensor includes an exhaust gas sensor.

11. An internal combustion engine having an intake, comprising:

a carburetor that regulates air flow;

a fuel injector adapter having a passageway in fluid communication with a fuel and air intake of the internal combustion engine and the carburetor; and a fuel injector extending through the fuel injector adapter;

wherein only fuel passing through the fuel injector is provided to the internal combustion engine.

12. The internal combustion engine of claim 11, further comprising:

an engine management system controlling fuel delivery through the fuel injector;

a desired load sensor providing a signal to the engine management system; and a speed sensor providing a signal relative to the speed of the engine to the engine management system.

13. The internal combustion engine of claim 12, wherein the load sensor includes a throttle position sensor.

14. The internal combustion engine of claim 11, whereby combustion air is provided to the internal combustion engine through the carburetor.

15. The internal combustion engine of claim 11, wherein the fuel injector includes an orifice directed into the inlet passageway of the fuel injector adapter and a fuel inlet in fluid communication with the orifice, further comprising:

a fuel pump pumping fuel toward the fuel injector inlet; and a fuel regulator intermediate the fuel pump and the fuel injector and in fluid communication with the fuel pump and fuel injector inlet.

16. The internal combustion engine of claim 11, wherein the carburetor has an inlet and an outlet and the fuel injector adapter extends from the carburetor inlet.

17. The internal combustion engine of claim 11, wherein the carburetor has an inlet and an outlet and the fuel injector adapter extends from the carburetor outlet.

18. The engine fuel and air delivery apparatus of claim 1, wherein fuel is blocked from the carburetor.

19. The engine fuel and air delivery apparatus of claim 1, wherein fuel is not in fluid communication with the carburetor.

20. The engine fuel and air delivery apparatus of claim 1, wherein the fuel is blocked from the carburetor such that the fuel is never provided to the engine through the carburetor.

21. The engine fuel and air delivery apparatus of claim 1, wherein the fuel is disconnected from the carburetor such that the fuel is never provided to the engine through the carburetor.

* * * * *